United States Patent [19]

Horntrich

[11] Patent Number: 4,972,587

[45] Date of Patent: Nov. 27, 1990

[54] DEVICE FOR PORTIONING SAUSAGELIKE FOOD PRODUCTS

[75] Inventor: Gunter Horntrich, Pforzheim, Fed. Rep. of Germany

[73] Assignee: EFFEM GmbH, Verden/Aller, Fed. Rep. of Germany

[21] Appl. No.: 445,682

[22] PCT Filed: Apr. 14, 1989

[86] PCT No.: PCT/DE89/00225

§ 371 Date: Dec. 7, 1989

§ 102(e) Date: Dec. 7, 1989

[87] PCT Pub. No.: WO89/09682

PCT Pub. Date: Oct. 19, 1989

[30] Foreign Application Priority Data

Apr. 14, 1988 [DE] Fed. Rep. of Germany ..... 3812336

[51] Int. Cl.[5] ..... B26B 3/00

[52] U.S. Cl. ..... 30/289; 30/1.5

[58] Field of Search ..... 30/1.5, 2, 278, 286, 30/289

[56] References Cited

U.S. PATENT DOCUMENTS 2,262,000 11/1941 Hjort ..... 30/1.5

3,940,842 3/1976 Perrinelle et al. ..... 30/289 X

*Primary Examiner*—Douglas D. Watts

*Attorney, Agent, or Firm*—Curtus, Morris & Safford

[57] ABSTRACT

A device for the portioning of sausagelike food products, characterized by a substantially axially symmetric caplike body made of a material having flexural elasticity, and comprising a section which is formed by an approximately L-shaped slot extending from an edge of the body in the direction of its bottom and then substantially parallel to the edge and the bottom of the body, and which when not loaded extends tangentially to the body and is provided with a cutting nose directed toward the interior of the body and lying approximately in the plane of the edge of the body.

5 Claims, 1 Drawing Sheet

DEVICE FOR PORTIONING SAUSAGELIKE FOOD PRODUCTS

BACKGROUND OF THE INVENTION

The invention relates to a device for the portioning of sausagelike food products.

At present, sausagelike food products are invariably divided into portions by means of a knife. This has the drawback that the portions are not equal since the knife is applied only by sight. Another disadvantage is that the exposed cut of the severed sausage soon dries out.

OBJECTS OF THE INVENTION

The invention has as its object to provide a device for the portioning of sausagelike food products wherein the cut surface of the sausage is covered as portions of equal size are severed.

SUMMARY OF THE INVENTION

In accordance with the invention, this object is accomplished through a substantially axially symmetric caplike body, made of a material having flexural elasticity. The body has a section which is formed by an approximately L-shaped slot extending from the edge of the body in the direction of its bottom and then substantially parallel to the edge and the bottom of the body. When not loaded, the slot extends tangentially to the body and is provided with a cutting nose directed toward the interior of the body lying approximately in the plane of the edge of the body.

A preferred embodiment is distinguished by the section being externally knurled with the cutting nose being triangular, and that the section is provided with a bending line.

An embodiment that is particularly preferred has the free end of the section joined to the body by a spur which is broken upon the first use.

BRIEF DESCRIPTION OF THE DRAWINGS

The invention will now be described in detail with reference to the accompanying drawing wherein.

DETAILED DESCRIPTION OF PREFERRED EMBODIMENT

Figure 1:
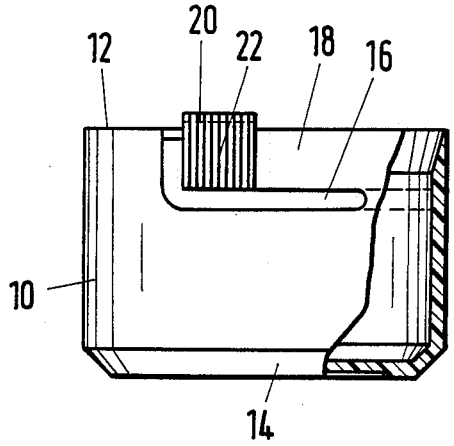
FIG. 1 is a side elevation of the proposed device.
Figure 2:
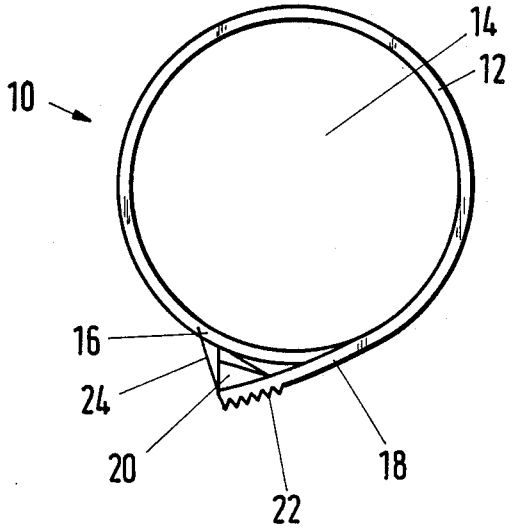
FIG. 2 is a plan view of the device shown in FIG. 1.

The device for the portioning of sausagelike food products consists of a caplike body 10 which has substantially axial symmetry and is made of a material having flexural elasticity, preferably a plastic. The caplike body 10 is provided with an L-shaped slot 16 which extends from the edge 12 of the body 10 in the direction of its bottom 14 and then substantially parallel to the edge 12 and the bottom 14 of the body 10 to define a section 18. When not loaded, this section 18 extends, by reason of the flexural elasticity of the material used, tangentially to the body 10. The section 18 carries a cutting nose 20 which is directed toward the interior of the body 10, lies approximately in the plane of the edge 12 of the body 10, and, in the preferred embodiment, is triangularly shaped.

When the caplike body is being used, one end of the sausage to be divided into portions is introduced into the cap until it strikes the bottom 14. Then the section 18 is loaded, preferably with the index finger, so that the cutting nose 20 is pressed into the casing of the sausage to be cut. At this juncture, turning the sausage on its own axis impresses a score line on the sausage along which it can be broken.

As the drawing further shows, the free end of the section 18 is joined to the remainder of the body 10 by a spur 24, which is broken upon the first use.

It is further apparent that the section 18 is externally knurled at 22 for ease of handling.

Not illustrated in the drawing is an embodiment in which the section 18 is provided with a bending line on which the section 18 is bent when loaded.

After the piece of sausage scored by means of the device has been broken off along the score line, it is removed from the cap, for example, simply by turning the latter upside down, and the remaining portion of the sausage is inserted in the body 10 so that the bottom 12 of the body covers the cut surface of the sausage, thus protecting it from drying out.

The device here proposed is suited especially for use with sausages serving as food for animals. It lends itself particularly well to the cutting of sausages sealed in film and marketed as dog food since the film is severed by the cutting nose.

The characteristics of the invention disclosed in the foregoing specification, in the drawing and in the claims may be material, individually or in any desired combination, to the implementation of the invention in various forms.

What is claimed is:

1. A device for the portioning of sausagelike food products, comprising a substantially axially symmetric caplike body having a top edge and a bottom made of a material having flexural elasticity, a section which is formed by an approximately L-shaped slot extending from said top edge of said body in the direction of said bottom and then substantially parallel to said edge and said bottom of said body, and which when not loaded extends tangentially to said body and a cutting nose carried by said section and directed toward the interior of said body and lying approximately in the plane of said edge of said body.

2. A device as defined in claim 1, wherein said section is externally knurled.

3. A device as defined in claim 1 or 2, wherein said cutting nose is triangularly shaped.

4. A device as defined in claim 1 or 2, wherein said section is provided with a bending line.

5. A device as defined in claim 1 or 2, wherein the free end of said section is joined to said body by a spur which is broken upon the first use.

* * * * *